United States Patent [19]

Schirmer

[11] 4,208,855

[45] Jun. 24, 1980

[54] CLOSURE FOR FLEXIBLE RECEPTACLE

[75] Inventor: Henry G. Schirmer, Spartanburg, S.C.

[73] Assignee: W. R. Grace & Co., Duncan, S.C.

[21] Appl. No.: 870,047

[22] Filed: Jan. 16, 1978

[51] Int. Cl.[2] ..... B65B 7/12; B65B 51/08

[52] U.S. Cl. ..... 53/417; 53/480; 53/483

[58] Field of Search ..... 53/410, 416, 417, 480, 53/481, 483, 370; 229/62, 65; 150/3; 24/30.5 W; 426/106, 410; 260/28.5 AV

[56] References Cited

U.S. PATENT DOCUMENTS

| | | | |
|---|---|---|---|
| 1,044,948 | 11/1912 | Ulmer | 53/483 X |
| 1,208,828 | 12/1916 | Planco | 53/483 |
| 2,346,613 | 4/1944 | Rumsey, Jr. | 53/370 |
| 2,543,229 | 2/1951 | Chapman | 156/334 |
| 2,628,214 | 2/1953 | Pinkney | 156/334 X |
| 2,746,225 | 5/1956 | Cloud | 53/370 |
| 3,111,796 | 11/1963 | Meissner | 53/481 |
| 3,113,408 | 12/1963 | Kirkpatrick et al. | 229/62 X |
| 3,197,938 | 8/1965 | Laloff | 53/140 |
| 3,308,936 | 3/1967 | Roland et al. | 229/65 |
| 3,358,905 | 12/1967 | Soesbergen | 229/62 |
| 3,620,774 | 11/1971 | Ford et al. | 426/106 |
| 3,896,067 | 7/1975 | Kosaka et al. | 260/28.5 AV |

FOREIGN PATENT DOCUMENTS

| | | | |
|---|---|---|---|
| 1408628 | 9/1964 | France | 53/370 |

*Primary Examiner*—John Sipos

*Attorney, Agent, or Firm*—John J. Toney; William D. Lee, Jr.; John B. Hardaway

[57] ABSTRACT

To provide a hermetic seal for flexible receptacles such as plastic bags, pouches, or casings, the outside of the mouth of the receptacle is coated with a cold flowing resin so that when the receptacle is filled and its mouth gathered under pressure the resin will cold flow and fill the voids in the gathered folds. Preferably, the end of the gathered mouth is trimmed and then high pressure is applied to cause the resin to exude from the trimmed end. Next, a forming plunger is used to press the exudate into a smooth surface whereby a fused cap of resin is formed hermetically closing the bag's mouth. As an alternative, a clip or band can be placed around the gathered end under sufficient pressure to case cold flow of the resin thereby sealing the voids.

9 Claims, 7 Drawing Figures

CLOSURE FOR FLEXIBLE RECEPTACLE

TECHNICAL FIELD

This invention relates to closures for flexible receptacles and to a method of forming same. Specifically, the present invention relates to a hermetic closure for a thermoplastic bag.

BACKGROUND ART

A number of methods have been employed in the prior art to hermetically seal flexible receptacles such as plastic bags, pouches, and casings. Generally, these methods have been either to heat seal the bag walls together or to apply metal or plastic clips or bands to the gathered and twisted neck of the receptacle or bag. However, while loading a product into a bag the heat seal area may be smeared with grease or otherwise contaminated or the bag walls may have a slight wrinkle or pucker which prevents the formation of a complete, continuous seal. A problem encountered in using clips or bands alone to close a bag is that small, interstitial, air passages or capillary-like voids will be often left open even after the clip or band has been applied under high pressure so that air will eventually leak into or out of the bag. Accordingly, it is one object of the subject invention to present a closure which will positively seal off and close any voids or leaks in the closure and provide a complete, continuous seal for the package.

In order to prevent leakage through gathered folds, preformed caps and caps or closures molded onto the twisted or gathered bag mouths have been used. One such closure is shown in U.S. Pat. No. 3,358,905 which issued on Dec. 19, 1967 to Adrianus Soesbergen wherein a band is placed around the gathered neck of a plastic bag and then a soldering bit is applied to heat melt the twisted end of the bag and close off any discharge passages or interstices which are present in the bag folds. However, if the bag material is a cross-linked or heat set polymer it will not melt and flow according to the Soesbergen patent. Accordingly, it is another object of the present invention to present a method of closing a flexible receptacle which will not be limited to the type of material from which the receptacle is made.

Other prior art closures for flexible receptacles such as bags are disclosed in U.S. Pat. Nos. 3,197,938 and 3,317,119 which issued on Aug. 3, 1965 and May 2, 1967 respectively to Jacob Lasoff.

The foregoing objects are accomplished by the invention which is described in the following paragraph.

DISCLOSURE OF INVENTION

In one aspect the subject invention is a process for closing an opening in a flexible receptacle by coating the surface of the receptacle which is adjacent the opening with a cold flowing resin; gathering the coated portion of the receptacle; applying sufficient pressure to the gathered portion to cause the resin to cold flow within the folds and thereby close off any passageways through which gases or liquids might leak into or out of the receptacle. As an additional step where preferred, the end of the gathered portion may be severed or trimmed off prior to applying high pressure to the gathered area so that a smooth surface is provided from which the exudate emerges. This exudate is can be molded into a cap-like closure.

In another aspect, the subject invention includes the step of applying a band around the gathered neck to continue.

In another aspect the subject invention is a closure for a gathered opening in a flexible receptacle which comprises a cap formed from a cold flowing resin with the material filling the interstices between folds of the gathered mouth formed integrally with the cap.

BRIEF DESCRIPTION OF DRAWINGS

In the drawings which are attached hereto and made a part of this disclosure.

BEST MODE FOR CARRYING OUT THE INVENTION

Figure 1:
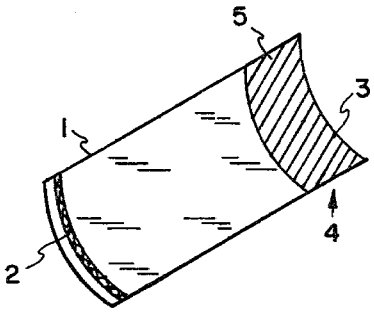
FIG. 1 shows a thermoplastic bag with a coating of cold flowing resin adjacent its mouth.

Referring first to FIG. 1, receptacle or bag 1 which is formed from flattened thermoplastic tubing by heat sealing one end thereof with a curved heat seal 2 is shown with the neck area 4 adjacent the mouth 3 coated with a cold flowing resin with the coating indicated by numeral 5. The thickness is preferably in the range of 1 mil to 10 mil for the coating although it may be greater or less than this range depending on the particular coating material.

Surprisingly, the coating 5 is placed on the outside of the bag results in a number of advantages, e.g., application of the coating to the outside of the bag is performed with relative ease by printing, brushing, spraying or the like as compared with attempting to coat the inside of the bag. Furthermore, a coating on the inside of the bag will become contaminated with grease or moisture from a product such as meat or food being inserted into the bag; and, as well as becoming contaminated by the filling of the bag, some of the coating will be scraped or rubbed off. Thus, the process of the subject invention performs the novel step of coating the outside of the mouth of a bag to be closed with a "cold flow" sealing material.

"Cold flow" as used herein means that the particular resin will flow under pressure at temperatures below the melting point of the film to which it is applied. Typical resins which are capable of cold flow and which form satisfactory seals can be selected from, but are not limited to, the class consisting of (a) organic-cellulose derivatives such as plasticized cellulose acetate or cellulose acetate butyrate, (b) thermoplastic resin such as polyvinyl butyrel, (c) thermosetting resins in the thermoplastic state such as resorcinol-formaldehyde, (d) formulated catalyzed alfa-chloro-acrylonitrile and alfa-chloro-acrylates, (e) paraffin and paraffin dispersions, and (f) the preferred cold flow resin compositions which are emulsions of ethylene-vinyl acetate copolymer and wax. It is to be understood that the subject invention contemplates the use of plasticizers and solvents as needed to impart to any of the foregoing classes of plastics the desired degree of flow which can be readily determined by those skilled in the art. In addition, a coating which is chemically cross-linkable can be used, such coating preferably being cross-linkable under heat and pressure as is an ethylene vinyl acetate wax with a peroxide cross-linking initiator. Peroxide initiators are well known in the art. It is to be further understood that the subject invention is not limited to the foregoing classes of cold flowing resins but any such suitable resin as defined may be used.

Figure 2:
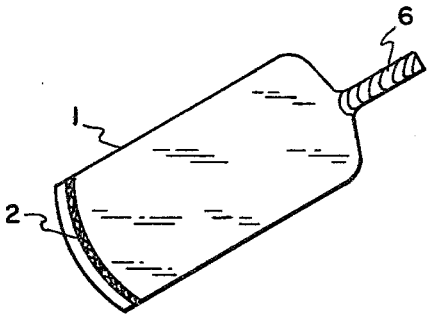
FIG. 2 shows the bag of FIG. 1 with the mouth area gathered and twisted.

In FIG. 2 the bag neck area or, rather, the portion of the bag adjacent the mouth or opening in the receptacle has been gathered and subsequently twisted. This gathering and twisting can be done manually; or, if the bag 1 has been evacuated after having been filled with a product by insertion of a vacuum nozzle into the bag mouth, the twisting and gathering can be performed below the tip of the nozzle so that the vacuum can be preserved. On the other hand, twisting may be eliminated if a mechanical gathering device is used, such as gathering arms or clamps, which are capable of exerting sufficient pressure to induce cold flow.

Figure 3:
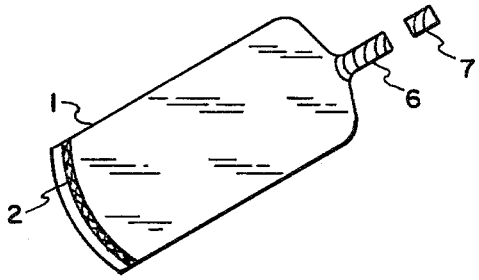
FIG. 3 shows the trimming or severing of the end of the twisted portion of the bag of FIG. 2.

In FIG. 3, a portion 7 of the gathered neck 6 has been severed or trimmed off so that a clean smooth surface is provided at the outer tip of the neck portion 6.

Figure 4:
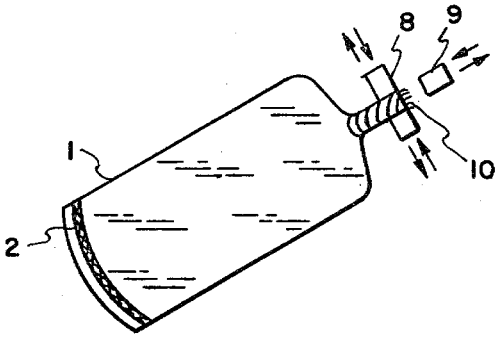
FIG. 4 shows the application of high pressure to the twisted and trimmed gathered portion of the bag shown in FIG. 3 with the molding plunger in place.
Figure 5:
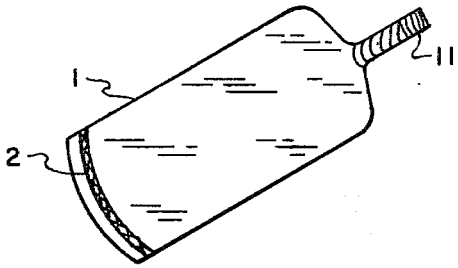
FIG. 5 shows the bag of FIG. 4 with the finished closure formed thereon.

FIG. 4 shows a schematically represented clamping device 8 applying high pressure to the gathered neck area so that the resin flows within the gathered folds and exudes from the trimmed end of the gathered area as exudate 10. The clamping or pressure applying device 8 can be any convenient device such as a clamp, vise, or the like. What is necessary is that sufficient pressure be applied so that the resin will flow under pressure. When sufficient exudate has emerged, plunger 9 is applied to form a cap like closure from the extrudate. The finished closure with cap 11 will have an overall appearance with a disk shaped top and cylindrical side wall similar to that shown in FIG. 5 when sufficient exudate is present. Enough coating material should be used to at least cover the gathered end in a disk shaped cap. For the maximum sealing effect, a metal clip or band could be applied around the bag neck and if the sealed package is to be subjected to considerable abuse as in transportation or in a showcase for retail display then such a clip or band would be desirable. A suitable clip and clipping device is shown and described in U.S. Pat. No. 3,584,347 which issued on June 15, 1971 to K. A. Klenz. FIG. 1 of the Klenz patent shows an inverted, U-shaped, deformable metal clip around a gathered bag neck with the legs of the inverted U resting in the guide grooves of a die or anvil. Pressure against the clip from above by a punch bends the legs of the U around the bag neck. With sufficient pressure from the punch the cold flowing resin can be made to flow as the clip is applied thereby positively sealing the interstices or voids between bag neck folds. In addition, moderate heat can be applied to aid in the flow of the resin, the criterion being, as stated above, that the resin flows below the melt temperature of the film.

Figure 6:
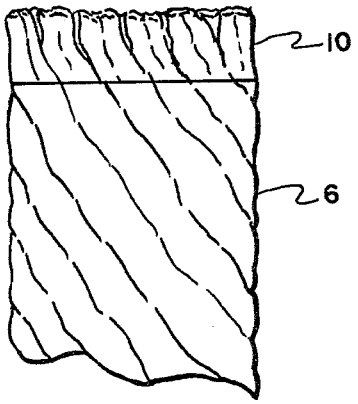
FIG. 6 is an enlargement of the twisted or gathered area of the bag shown in FIG. 4; and, FIG. 7 shows the formation of the cap on the twisted end of the bag by use of the molding plunger.
Figure 7:
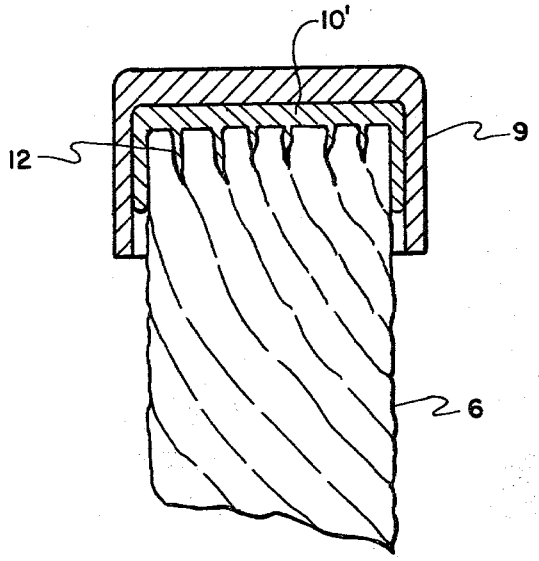

FIG. 6 shows in detail the exudate 10 emerging from the twisted and compressed end 6 which occurs when pressure is applied as illustrated in FIG. 4. FIG. 7 shows the application of the forming plunger 9 to form the exudate 10′ into a cap like closure with the resin 12 filling the capillary-like voids extending down into the folds of the twisted end 6. These resin fillings 12 are integral with the molded cap 10′ and provide complete blockage of any interstices or voids that might allow air or gases to enter or leave the receptacle. Removal of the plunger 9 leaves the smooth, rounded cap-like closure on the twisted bag end and this closure may be readily removed or cut off when opening of the receptacle is desired.

As another embodiment of the subject invention, a polymeric resin which will crystallize is either coextruded or melt coated on to the outside of the bag mouth. The coating is then rapidly quenched by application of chilled air or cold water spray thus rendering the coating amorphous and cold flowable. The step of gathering the bag mouth is then performed and while gathered under pressure the resin cold flows within the folds. Afterwards heat is applied to the gathered area to cause the resin to crystallize. One resin which is suitable for this embodiment is trans-1,4-polyisoprene which is a crystallizable rubber capable of cold flow in its amorphous state.

INDUSTRIAL APPLICABILITY

The bag closure described hereinabove finds its major industrial use in the hermetic sealing of evacuated bags or receptacles which have been filled with fresh meat such as beef and pork primals or subprimals, poultry such as whole chicken or parts thereof, turkey, duck and geese, and dairy products such as large blocks of cheese. The closure also finds application in sealing packages for frozen foods including vegetables and for liquid containing packages such as blood plasma or for sealing bags enclosing anhydrous powder compositions.

As a typical example of industrial application, the bag 1 is made from tubular, heat-shrinkable copolymer film, the copolymer being the copolymer of vinylidene chloride and vinyl chloride commonly known as saran. The tube is closed by heat seal 2 which is formed by heated jaws to form a bag. Bags will preferably have a lay-flat width of 3 to 18 inches and a length of 6 to 36 inches. The coating of an emulsion of ethylene-vinyl acetate copolymer and wax is applied across the width of the bag for about 20 to 25% of the length of the bag immediately adjacent the bag's mouth. After the bag is filled with a beef tenderloin, boned ham, or other meat product, a vacuum nozzle is inserted within the bag, the bag evacuated, the neck twisted to cause the resin to flow, a clip applied under pressure and the excess film trimmed off above the clip. The cold flowing resin which exudes from the trimmed end is flattened and smoothed by a plunger and allowed to cool. The result is a positively sealed bag.

Having thus described by invention, I claim:

1. A process for closing an opening in a pre-formed flexible receptacle comprising the steps of:
   (a) coating the outer surface of the pre-formed receptacle which is immediately adjacent said opening with a cold flowing resin; then,
   (b) gathering said coated portion of the receptacle into compact folds; and
   (c) applying sufficient pressure to said gathered portion to cause said resin to cold flow within the folds and to exude from the outer end of said gathered portion thereby filling the voids therein and forming a hermetic closure for the receptacle from said exuded resin.

2. The process of claim 1 including the step of twisting said gathered portion of the receptacle.

3. The process of claim 1 wherein said cold flowing resin is an emulsion comprising wax and an ethylene vinyl acetate copolymer.

4. The process of claim 1 wherein said receptacle is a bag formed from thermoplastic film.

5. The process of claim 1 including the step of placing a clip around said gathered portion.

6. The processs of claim 1 including the steps of: (i) filling said receptacle with a product and (ii) evacuating gases from the interior of said receptacle prior to the step of gathering said coated portion of said receptacle.

7. The process of claim 1 wherein said resin is a crystallizable resin and including after step (c) the step of heating the gathered portion to cause said resin to crystallize.

8. The process of claim 1 wherein said resin is cross-linkable and includes a chemical cross-linking agent and including the step of heating said gathered portion to cause said resin to cross-link.

9. A process for closing an opening in a flexible receptacle comprising the steps of:

(a) coating the outer surface of the receptacle which is adjacent said opening with a cold flowing resin; then, (b) gathering said coated portion of the receptacle into compact folds;

(c) applying sufficient pressure to said gathered portion to cause said resin to cold flow within the folds and fill the voids therein whereby said opening is closed and sealed and resin exudes from the outer end of said gathered portion; and, (d) forming a cap-like closure from said exuded resin.

* * * * *